US009981496B2

(12) United States Patent
Sawada et al.

(10) Patent No.: US 9,981,496 B2
(45) Date of Patent: May 29, 2018

(54) PRINTING DEVICE, CONTROL METHOD THEREOF, AND MANUFACTURING METHOD OF PRINTED MATTER

(71) Applicant: Dai Nippon Printing Co., Ltd., Tokyo (JP)

(72) Inventors: Koichi Sawada, Tokyo (JP); Naoki Takizawa, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days. days.

(21) Appl. No.: 15/539,359

(22) PCT Filed: Apr. 8, 2016

(86) PCT No.: PCT/JP2016/061546
§ 371 (c)(1),
(2) Date: Jun. 23, 2017

(87) PCT Pub. No.: WO2016/163518
PCT Pub. Date: Oct. 13, 2016

(65) Prior Publication Data

US 2017/0355211 A1 Dec. 14, 2017

(30) Foreign Application Priority Data

Apr. 10, 2015 (JP) ..... 2015-081121

(51) Int. Cl.
*B41J 17/02* (2006.01)
*B41M 5/42* (2006.01)
(Continued)

(52) U.S. Cl.
CPC ..... *B41M 5/42* (2013.01); *B41J 2/325* (2013.01); *B41J 17/02* (2013.01); *B41M 7/0027* (2013.01)

(58) Field of Classification Search
CPC ..... B41J 2/325; B41J 17/02; B41M 5/42
See application file for complete search history.

(56) References Cited

U.S. PATENT DOCUMENTS 8,081,201 B2 * 12/2011 Hirota ..... B41J 17/38 347/217
8,308,262 B2 * 11/2012 Yoshida ..... B41J 11/0015 347/102
(Continued)

FOREIGN PATENT DOCUMENTS

JP 3185254 B2 7/2001
JP 2009-137020 A1 6/2009
(Continued)

OTHER PUBLICATIONS

International Search Report and Written Opinion (Application No. PCT/JP2016/061546) dated Jun. 14, 2016.
(Continued)

*Primary Examiner* — Lamson Nguyen
(74) *Attorney, Agent, or Firm* — Burr & Brown, PLLC

(57) ABSTRACT

When a roughened pattern is formed on an image protection layer, a thermal transfer sheet is protected from being damaged or broken. A thermal head 18 is driven and controlled such that an image protection layer 15*e* of a thermal transfer sheet 15 is thermally transferred to a printing medium 14, and that a roughened pattern 40 is formed on the image protection layer 15*e*. The roughened pattern 40 is made based on a corrected pattern 40B that is obtained by correcting a basic pattern 40A that is a pattern including an island portion formed of a mass of a plurality of high-energy pixels 40*a*, such that the high-energy pixel 40*a* surrounded by the high-energy pixels 40*a* forming an edge area of the island portion is converted to a low-energy pixel 40*b*.

10 Claims, 6 Drawing Sheets

(51) Int. Cl.
*B41J 2/325* (2006.01)
*B41M 7/00* (2006.01)

(56) References Cited

U.S. PATENT DOCUMENTS

| | | | | |
|---|---|---|---|---|
| 8,976,213 | B2 * | 3/2015 | Otoshi | B41J 11/0095 347/218 |
| 2009/0165934 | A1 | 7/2009 | Koike | |
| 2012/0154505 | A1 | 6/2012 | Kaechi | |

FOREIGN PATENT DOCUMENTS

| | | | |
|---|---|---|---|
| JP | 2009-154410 | A1 | 7/2009 |
| JP | 2012-126031 | A1 | 7/2012 |
| JP | 2015-071227 | A1 | 4/2015 |

OTHER PUBLICATIONS

English translation of International Preliminary Report on Patentability (Chapter I) (Application No. PCT/JP2016/061546) dated Oct. 19, 2017, 7 pages.

* cited by examiner

PRINTING DEVICE, CONTROL METHOD THEREOF, AND MANUFACTURING METHOD OF PRINTED MATTER

TECHNICAL FIELD

The present invention relates to a printing device that thermally transfers an image protection layer on an image formed on a printing medium, and provides a roughened pattern with the image protection layer, a control method thereof, and a manufacturing method of a printed matter.

BACKGROUND ART

A printing device that thermally transfers color materials of a thermal transfer sheet onto a printing medium to form an image, so as to manufacture a printed matter has been conventionally known. In order to protect the image formed on the printing medium, such a printing device forms a transparent image protection layer on the image. In this case, a surface of the image protection layer for protecting the image is subjected to a matte processing to form thereon a roughened pattern, whereby the printed matter has a matte finish.

As described above, the conventional printing device subjects the image protection layer surface to a matte processing to form thereon a roughened pattern. The roughened pattern has a plurality of pixels arranged like a grid, which include high-energy pixels that are formed by applying high energy, and low-energy pixels that are arranged between the high-energy pixels and formed by applying low energy.

However, when a mass of the high-energy pixels enlarges, there is a possibility that thermal energy of the high-energy pixels excessively increases, which impairs glossiness of the roughened pattern as a whole.

Patent Document: W318525413

DISCLOSURE OF THE INVENTION

The present invention has been made in view of the above points. The object of the present invention is to provide a printing device that can prevent that, when a roughened pattern is formed on an image protection layer of a thermal transfer sheet, even if there is a mass of high-energy pixels, thermal energy of high-energy pixels excessively increases so that glossiness as a whole is impaired.

The present invention is a printing device comprising: a printing-medium running unit that causes a printing medium to run; a sheet supply unit that supplies a thermal transfer sheet onto the printing medium, the thermal transfer sheet having at least an image protection layer to be thermally transferred to the printing medium; a thermal head having a plurality of heating elements that are linearly located in a direction perpendicular to a direction along which the printing medium runs; and a control means that drives and controls the thermal head; wherein: the control means drives and controls the thermal head to thermally transfer the image protection layer of the thermal transfer sheet to the printing medium, and to form a roughened pattern on the image protection layer; and the roughened pattern is composed of a plurality of pixels which are arranged like a grid and include high-energy pixels and low-energy pixels between the high-energy pixels, and the roughened pattern is made based on a corrected pattern that is obtained by correcting a basic pattern that is a pattern including an island portion formed of a mass of the plurality of high-energy pixels, such that the high-energy pixel surrounded by the high-energy pixels forming an edge area of the island portion is converted to the low-energy pixel.

The present invention is a printing device comprising: a printing-medium running unit that causes a printing medium to run; a sheet supply unit that supplies a thermal transfer sheet onto the printing medium, the thermal transfer sheet having at least an image protection layer to be thermally transferred to the printing medium; a thermal head having a plurality of heating elements that are linearly located in a direction perpendicular to a direction along which the printing medium runs; and a control means that drives and controls the thermal head; wherein: the control means drives and controls the thermal head to thermally transfer the image protection layer of the thermal transfer sheet to the printing medium, and to form a roughened pattern on the image protection layer; the roughened pattern is composed of a plurality of pixels which are arranged like a grid and include high-energy pixels and low-energy pixels between the high-energy pixels, and the roughened pattern is made based on a corrected pattern that is obtained by correcting a basic pattern that is a pattern including an island portion formed of a mass of the plurality of high-energy pixels, such that the high-energy pixel surrounded by the high-energy pixels forming an edge area of the island portion is converted to the low-energy pixel; and the corrected pattern is obtained by correcting the basic pattern such that a target high-energy pixel surrounded by the high-energy pixels adjacent thereto from above, from below, from the right and from the left is converted to the low-energy pixel.

The present invention is the printing device wherein the high-energy pixels forming the edge area of the island portion are the high-energy pixels arranged in a plurality of rows.

The present invention is the printing device wherein the high-energy pixels forming the edge area of the island portion are the high-energy pixels arranged in a single row.

The present invention is a control method of a printing device comprising: a step in which a printing medium is caused to run by a printing-medium running unit; a step in which a thermal transfer sheet is caused to run on the printing medium by a sheet running unit, the thermal transfer sheet having at least an image protection layer to be thermally transferred to the printing medium; and a step in which the image protection layer of the thermal transfer sheet is thermally transferred to the printing medium by a thermal head having a plurality of heating elements that are linearly located in a direction perpendicular to a direction along which the printing medium runs, the thermal head being driven and controlled by a control means; wherein: the control means drives and controls the thermal head to thermally transfer the image protection layer of the thermal transfer sheet to the printing medium, and to form a roughened pattern on the image protection layer; and the roughened pattern is composed of a plurality of pixels which are arranged like a grid and include high-energy pixels and low-energy pixels between the high-energy pixels, and the roughened pattern is made based on a corrected pattern that is obtained by correcting a basic pattern that is a pattern including an island portion formed of a mass of the plurality of high-energy pixels, such that the high-energy pixel surrounded by the high-energy pixels forming an edge area of the island portion is converted to the low-energy pixel.

The present invention is a control method of a printing device comprising: a step in which a printing medium is caused to run by a printing-medium running unit; a step in which a thermal transfer sheet is caused to run on the printing medium by a sheet running unit, the thermal transfer sheet having at least an image protection layer to be thermally transferred to the printing medium; and a step in which the image protection layer of the thermal transfer sheet is thermally transferred to the printing medium by a thermal head having a plurality of heating elements that are linearly located in a direction perpendicular to a direction along which the printing medium runs, the thermal head being driven and controlled by a control means; wherein: the control means drives and controls the thermal head to thermally transfer the image protection layer of the thermal transfer sheet to the printing medium, and to form a roughened pattern on the image protection layer; the roughened pattern is composed of a plurality of pixels which are arranged like a grid and include high-energy pixels and low-energy pixels between the high-energy pixels, and the roughened pattern is made based on a corrected pattern that is obtained by correcting a basic pattern that is a pattern including an island portion formed of a mass of the plurality of high-energy pixels, such that the high-energy pixel surrounded by the high-energy pixels forming an edge area of the island portion is converted to the low-energy pixel; and the corrected pattern is obtained by correcting the basic pattern such that a target high-energy pixel surrounded by the high-energy pixels adjacent thereto from above, from below, from the right and from the left is converted to the low-energy pixel.

The present invention is a manufacturing method of a printed matter comprising: a step in which a printing medium is caused to run by a printing-medium running unit; a step in which a thermal transfer sheet is caused to run on the printing medium by a sheet running unit, the thermal transfer sheet having at least an image protection layer to be thermally transferred to the printing medium; a step in which the image protection layer of the thermal transfer sheet is thermally transferred to the printing medium by a thermal head having a plurality of heating elements that are linearly located in a direction perpendicular to a direction along which the printing medium runs, the thermal head being driven and controlled by a control means; and a step in which a printed matter is obtained by punching the printing medium to which the image protection layer has been thermally transferred; wherein: the control means drives and controls the thermal head to thermally transfer the image protection layer of the thermal transfer sheet to the printing medium, and to form a roughened pattern on the image protection layer; and the roughened pattern is composed of a plurality of pixels which are arranged like a grid and include high-energy pixels and low-energy pixels between the high-energy pixels, and the roughened pattern is made based on a corrected pattern that is obtained by correcting a basic pattern that is a pattern including an island portion formed of a mass of the plurality of high-energy pixels, such that the high-energy pixel surrounded by the high-energy pixels forming an edge area of the island portion is converted to the low-energy pixel.

The present invention is a manufacturing method of a printed matter comprising: a step in which a printing medium is caused to run by a printing-medium running unit; a step in which a thermal transfer sheet is caused to run on the printing medium by a sheet running unit, the thermal transfer sheet having at least an image protection layer to be thermally transferred to the printing medium; a step in which the image protection layer of the thermal transfer sheet is thermally transferred to the printing medium by a thermal head having a plurality of heating elements that are linearly located in a direction perpendicular to a direction along which the printing medium runs, the thermal head being driven and controlled by a control means; and a step in which a printed matter is obtained by punching the printing medium to which the image protection layer has been thermally transferred; wherein: the control means drives and controls the thermal head to thermally transfer the image protection layer of the thermal transfer sheet to the printing medium, and to form a roughened pattern on the image protection layer; the roughened pattern is composed of a plurality of pixels which are arranged like a grid and include high-energy pixels and low-energy pixels between the high-energy pixels, and the roughened pattern is made based on a corrected pattern that is obtained by correcting a basic pattern that is a pattern including an island portion formed of a mass of the plurality of high-energy pixels, such that the high-energy pixel surrounded by the high-energy pixels forming an edge area of the island portion is converted to the low-energy pixel; and the corrected pattern is obtained by correcting the basic pattern such that a target high-energy pixel surrounded by the high-energy pixels adjacent thereto from above, from below, from the right and from the left is converted to the low-energy pixel.

As described above, according to the present invention, when a roughened pattern is formed on an image protection layer of a thermal transfer sheet, since a high-thermal energy surrounded by high-energy pixels forming an edge area is converted to a low-energy pixel, there is no possibility that thermal energy of the high-energy pixels excessively increases, whereby glossiness as a whole can be improved.

DESCRIPTION OF THE PREFERRED EMBODIMENTS

Figure 1:
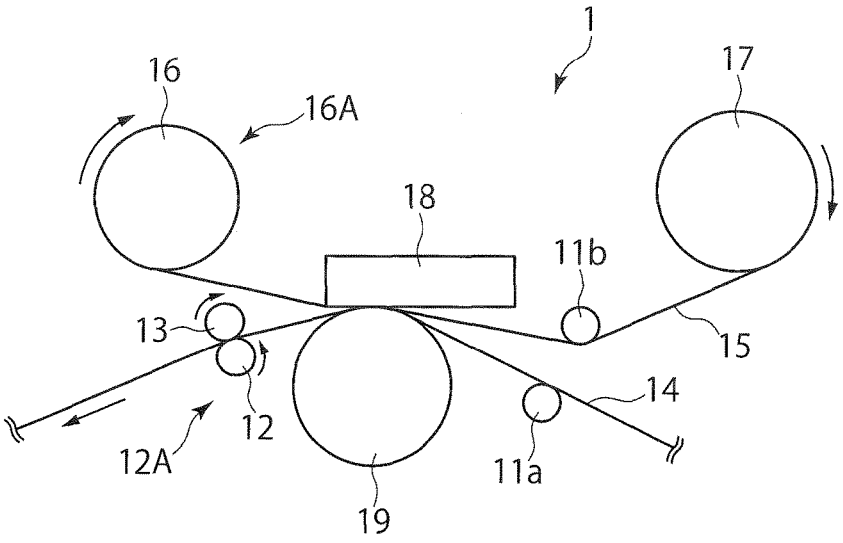
FIG. 1 is a view showing a structure of a printing device according to the present invention.

An embodiment of the present invention will be described herebelow with reference to the drawings. FIGS. 1 to 10 are views showing a printing device according to the present invention and a control method thereof.

As shown in FIGS. 1 to 5, a printing device 1 includes: a guide roller 11*a* that guides a printing medium 14 such as a photographic paper extending like a strip; a drive roller 12 and a pinch roller 13 which cause the printing medium 14 to run; a supply reel 17 that supplies a thermal transfer sheet 15; a guide roller 11*b* that guides the thermal transfer sheet 15; a take-up reel 16 that takes up the thermal transfer sheet 15; and a thermal head 18 having a plurality of heating elements 18*a* that are linearly located in a direction perpendicular to the direction along which the printing medium 14 runs.

The drive roller 12 and the pinch roller 13 constitute a printing-medium running unit 12A that causes the printing medium 14 to run, and the take-up reel 16 and the supply reel 17 constitute a sheet running unit 16A that causes the thermal transfer sheet 15 to run.

The heating elements 18*a* of the thermal head 18 thermally transfer, in a line, color material layers 15*b*, 15*c* 15*d* and an image protection layer 15*e* of the thermal transfer sheet 15, which are interposed between the printing medium 14 and the thermal transfer sheet 15, onto the printing medium 14.

In the printing device 1, when the take-up reel 16 is driven in rotation, the thermal transfer wheel 15 is caused to run from the supply reel 17 to the take-up reel 16. At a printing position at which the color material layers 15*b*, 15*c*, 15*d* of the thermal transfer sheet 15 are transferred to the printing medium 14, a platen roller 19 is located opposedly to the thermal head 18. A color material such as a dye is pressed onto the printing medium 14 by the thermal head 18 with a predetermined pressure, so that the color material is thermally transferred from the thermal transfer sheet 15 to the printing medium 14.

Figure 2:
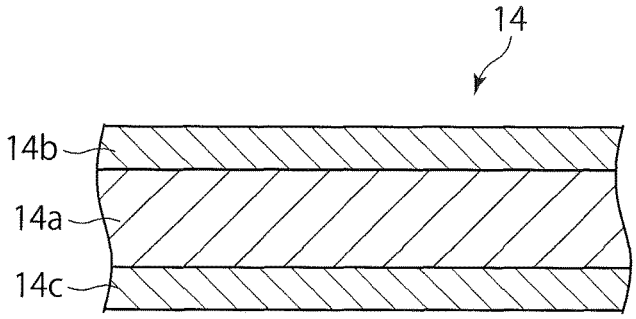
FIG. 2 is a sectional view of a printing medium used in the printing device.

The printing medium 14 is described with reference to FIG. 2. The printing medium 14 includes a substrate 14*a* formed of paper (pulp), polypropylene (PP), polyethylene terephthalate (PET) or the like. On one surface of the substrate 14*a*, a recipient layer 14*b* that receives a dye to be transferred from the thermal transfer sheet 15 and holds the received dye, is provided. The recipient layer 14*b* is formed of an acryl-based resin, a thermoplastic resin such as polyester, polycarbonate or polyvinyl chloride. A back layer 14*c* is formed on the other surface of the substrate 14*a*.

Figure 3:
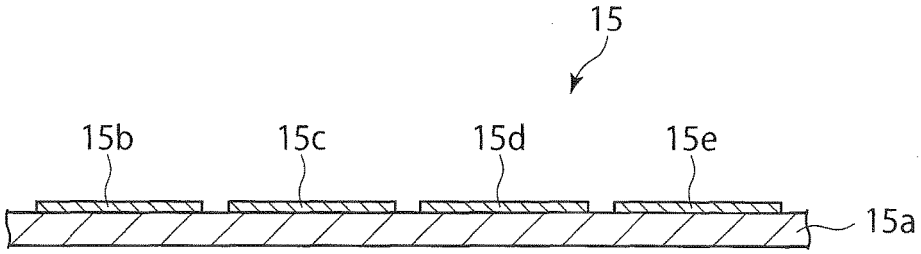
FIG. 3 is a sectional view of a thermal transfer sheet used in the printing device.
Figure 4:
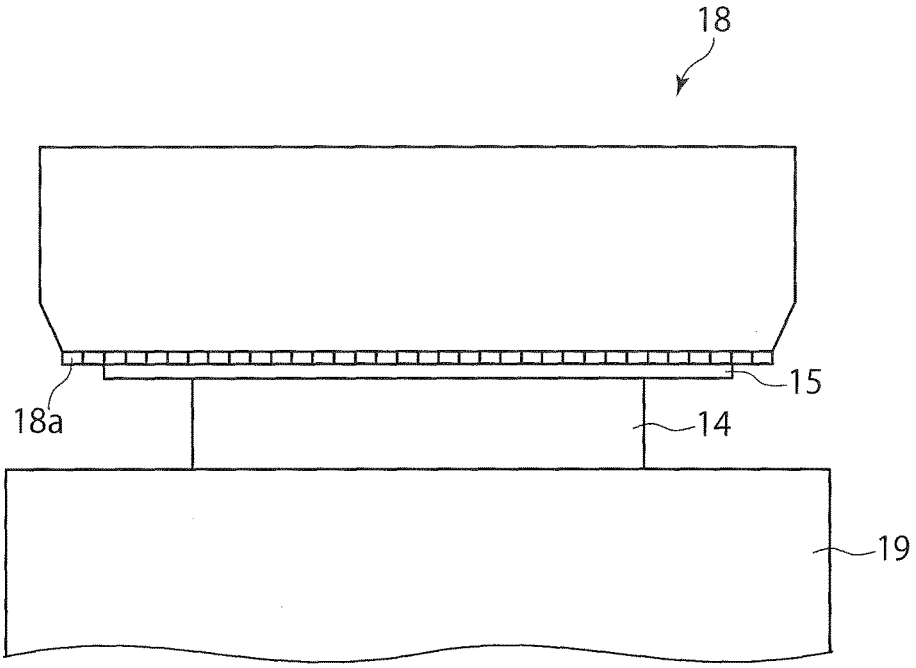
FIG. 4 is a front view of a thermal head of the printing device.

On the other hand, as shown in FIG. 3, the thermal transfer sheet 15 includes a substrate 15*a* formed of a synthetic resin film such as a polystyrene film. One surface of the substrate 15*a* is provided with the color material layers 15*b*, 15*c*, 15*d* for forming an image, including color materials such as respective color dyes or pigments of yellow, magenta and cyanogen, and a thermoplastic resin. In addition, the image protection layer 15*e* formed of a thermoplastic resin is formed on the substrate 15*a*. The color material layers 15*b*, 15*c*, 15*d* and the image protection layer 15*e* constitute one set, and these sets of layers 15*b* to 15*e* are sequentially formed side by side in the longitudinal direction. When thermal energy according to data of an image to be printed is applied by the thermal head 18 to the color material layers 15*b*, 15*c*, 15*d*, the color material layers 15*b*, 15*c*, 15*d* are thermally transferred to the recipient layer 14*b* of the printing medium 14 (see FIGS. 6A, 6B, 6C).

To be specific, the color material layers 15*b*, 15*c* 15*d* are formed by dispersing a sublimation dye or a thermal diffusion dye in a cellulose-based resin such as methyl cellulose, ethyl cellulose, hydroxyl ethyl cellulose, hydroxyl propyl cellulose or cellulose acetate, a vinyl-based resin such as polyvinyl alcohol, polyvinyl butyral, polyvinyl acetoacetal, poly acetate vinyl or polystylene, or other various kinds of urethane resins.

In addition, the image protection layer 15*e* is formed of a thermoplastic resin such as a polyester-based resin or a cellulose ester-based resin. Further, in order to improve image preservation, an ultraviolet absorbent, a light stabilizer, an anti-oxidant and so on may be added.

The image protection layer 15*e* is further thermally transferred onto images 15*bb*, 15*cc*, 15*dd* which are formed by the thermally transferred color material layers 15*b*, 15*c*, 15*d*. At this time, the image protection layer 15*e* thermally transferred to the printing medium 14 is subjected to a fine roughening process by thermal energy of the thermal head 18, so that a surface of the image protection layer 15*e* has a roughened pattern 40.

Next, a printed matter obtained by thermally transferring the thermal transfer sheet 15 onto the printing medium 14 is described with reference to FIGS. 6A to 6C.

Figure 6A:
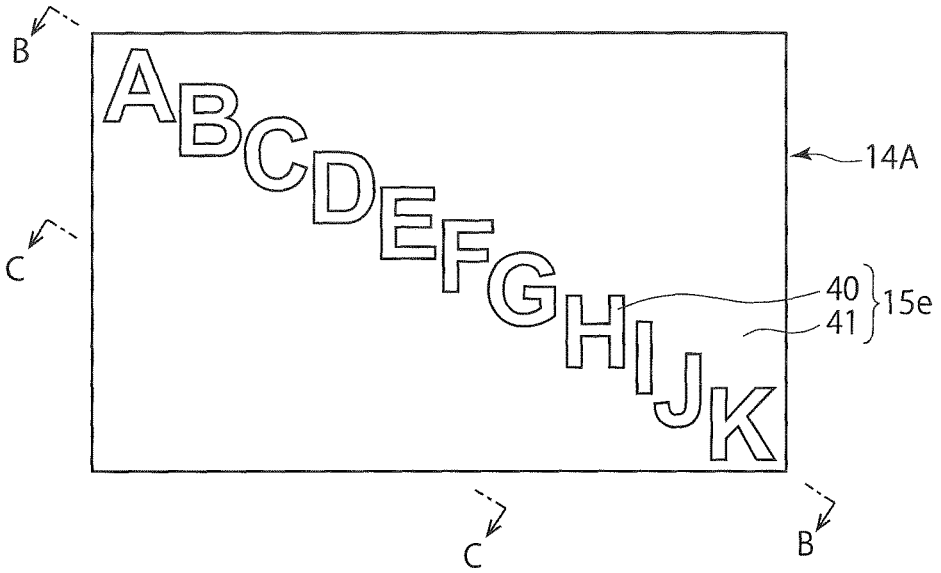
FIG. 6A is a plan view showing a printed matter.
Figure 6B:
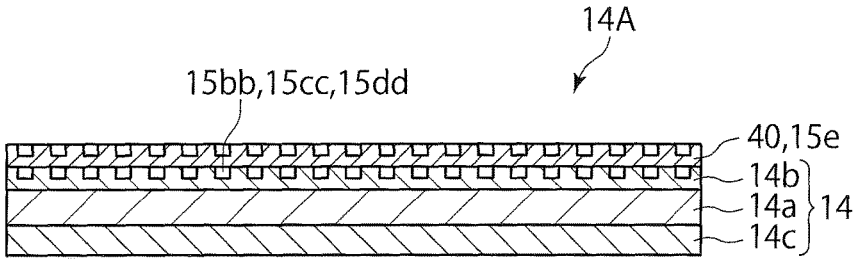
FIG. 6B is a sectional view of FIG. 6A taken along a B-B line thereof.
Figure 6C:
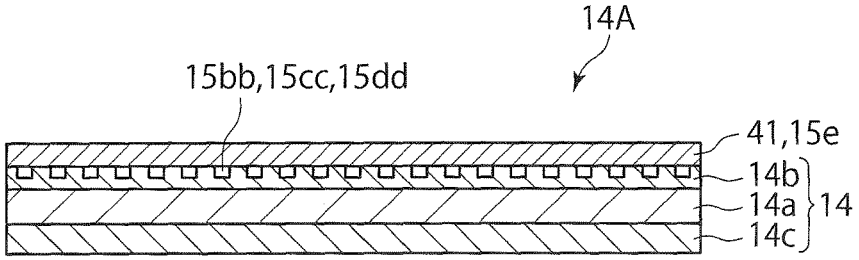
FIG. 6C is a sectional view of FIG. 6A taken along a C-C line thereof.

As shown in FIGS. 6A to 6C, the color material layers 15*b*, 15*c*, 15*d* of the thermal transfer sheet 15 are thermally transferred onto the printing medium 14 by the thermal head 18 of the printing device 1, so that the images 15*bb*, 15*cc*, 15*dd* are formed on the printing medium 14. Then, the image protection layer 15*e* is thermally transferred onto the images 15*bb*, 15*cc*, 15*dd*.

Then, the printing medium 14 is punched to have a desired shape. Thus, a printed matter 14A, such as a card, which includes the printing medium 14, the images 15*bb*, 15*cc*, 15*dd* and the image protection layer 15*e*, is obtained.

In such a printed matter 14A, as described above, the image protection layer 15*e* is subjected to a fine roughening process by the thermal energy of the thermal head 18, so that the roughened pattern 40 is formed on the surface (see FIG. 6A). In this case, the image protection layer 15*e* is formed all over a surface of the printed matter 14A. Further, the roughened pattern 40, which has been formed by the fine roughening process, and a glossy area 41 other than the roughened pattern are formed on the image protection layer 15*e*.

FIG. 6A is a plan view showing the printed matter 14A. FIG. 6B is a sectional view of FIG. 6A taken along a B-B line thereof. FIG. 6C is a sectional view of FIG. 6A taken along a C-C line thereof. FIG. 6A shows the printed matter 14A without its images, for the sake of conveniences.

The roughened pattern 40 of the image protection layer 15*e* of the printed matter 14A is formed in a manner as described below. Namely, a pattern including a plurality of pixels 40*a*, 40*b* arranged like a grid is referred to as basic pattern A, the pixels 40*a*, 40*b* including high-energy pixels 40*a* and low-energy pixels 40*b* between the high-energy pixels 40*a* (see FIG. 7A). The basic pattern 40A is obtained by preparing a silver salt matte sheet, which is generally considered as preferable and set as a benchmark, and extracting a feature of a matte pattern which is obtained by scanning the silver salt matte sheet. The basic pattern 40A includes an island portion 50 formed of a mass of the plurality of high-energy pixels 40*a*.

Figure 7B:
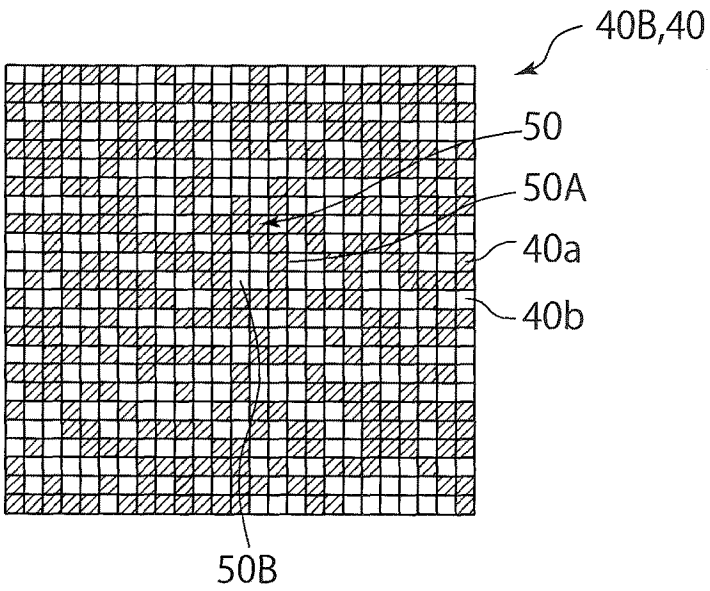
FIG. 7B is a view showing the roughened pattern.
Figure 7A:
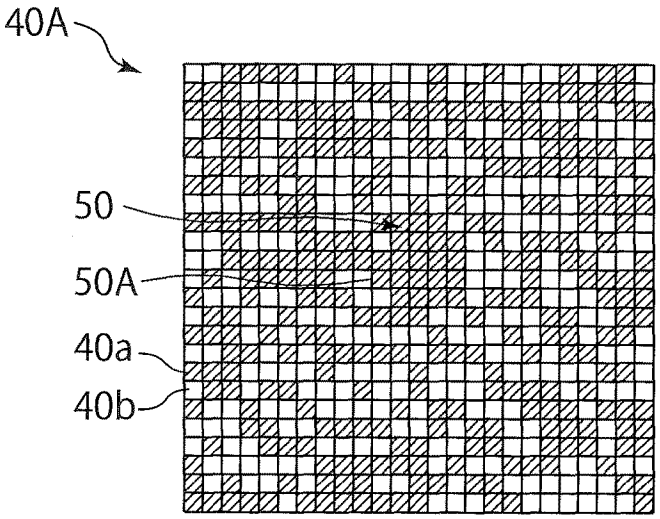
FIG. 7A is a view showing a roughened pattern.

In the island portion 50 of the basic pattern 40A as structured above, the high-energy pixels 40*a* in an area (inner area) 50B surrounded by the high-energy pixels 40*a* forming an edge area 50A are converted to the low-energy pixels 40*b*, so as to obtain a corrected pattern 40B (see FIG. 7B). The roughened pattern 40 of the image protection layer 15*e* can be made based on the thus obtained corrected pattern 40B.

In the roughened pattern 40, the high-energy pixels 40*a* are formed by imparting high energy from the heating elements 18*a* to the image protection layer 15*e*, while the low-energy pixels 40*b* are formed by imparting low energy from the heating elements 18*a* to the image protection layer 15*e*. In this case, the high-energy pixels 40*a* correspond to dents formed in the image protection layer 15*e* in reaction to the high energy from the heating elements 18*a*, and the low-energy pixels 40*b* correspond to bumps formed on the image protection layer 15*e* in reaction to the low energy from the heating elements 18*a*.

As described above, in the island portion 50 formed of the mass of high-energy pixels 40*a* of the basic pattern 40A, the high-energy pixels 40*a* in the inner area 50B surrounded by the high-energy pixels 40*a* forming the edge area 50A are converted to the low-energy pixels 40*b*, so that the corrected pattern 40B is obtained. The roughened pattern 40 is made based on the corrected pattern 40B. Thus, even when there is a mass of the high-energy pixels 40*a*, there is no possibility that thermal energy of the high-energy pixels 40*a* excessively increases so that the glossiness of the island portion 50 formed of the mass of the high-energy pixels 40*a* decreases.

On the other hand, when the island portion 50 formed of the high-energy pixels 40*a* in the basic pattern 40A is left as it is, the thermal energy of the high-energy pixels 40*a* of the island portion in the roughened pattern 40 increases. Thus, since the thermal energy of the dents increases, the glossiness of the roughened pattern 40 as a whole decreases.

The roughened pattern 40 is formed of a plurality of the pixels 40*a*, 40*b* arranged like a grid. The high-energy pixels 40*a* mean unit pixels that are obtained by imparting high energy from the heating elements 18*a* to the image protection layer 15*e*, while the low-energy pixels 40*b* mean unit pixels that are obtained by imparting low energy from the heating elements 18*a* to the image protection layer 15*e*.

The island portion 50 has a mass of the plurality of high-energy pixels 40*a*. The island portion 50 includes the edge area 50A composed of the high-energy pixels 40*a* forming a peripheral edge. The high-energy pixels 40*a* in the edge area 50A surround at least one high-energy pixel.

Figure 8A:
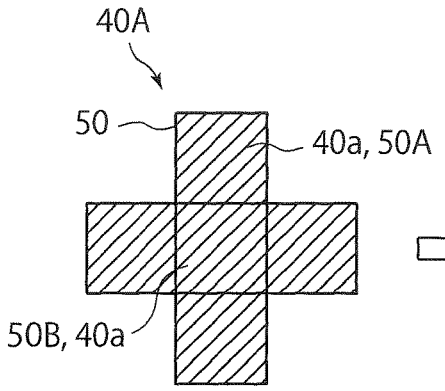
FIG. 8A is a view showing a method of forming the roughened pattern.
Figure 8B:
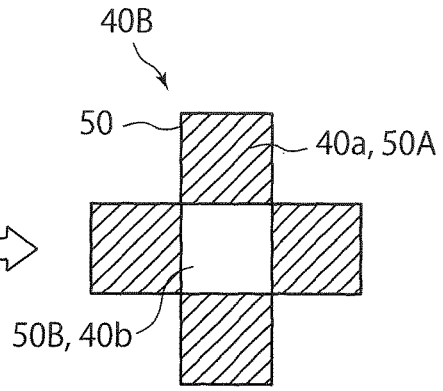
FIG. 8B is a view showing the method of forming the roughened pattern.

Next, a method of obtaining the corrected pattern 40B by correcting the basing pattern 40A including the island portion 50 formed of a mass of the high-energy pixels 40*a* is described with reference to FIGS. 8A and 8B.

In this case, in the island portion 50 of the basic pattern 40A, the high-energy pixels 40*a* of the inner area 50B surrounded by the high-energy pixels 40*a* forming the edge area 50A are converted to the low-energy pixels 40*b*. At this time, as shown in FIG. 8A, in the basic pattern 40A, one of the high-energy pixels 40*a* present in the inner area 50B surrounded by the edge area 50A is supposed as a target high-energy pixel 40*a*.

When the target high-energy pixel 40*a* is surrounded by high-energy pixels 40*a* adjacent thereto from above, from below, from the right and the left, the target high-energy pixel 40*a* is converted to the low-energy pixel 40*b* (see FIG. 8B). In fact, as described below, the conversion of the target high-energy pixel 40*a* is finally carried out, after various control steps have been repeated by the control unit 24.

Then, another high-energy pixel 40*a* present in the inner area 50B surrounded by the edge area 50A is supposed as a target high-energy pixel 40*a*. By repeating the method shown in FIGS. 8A and 8B, target high-energy pixels 40*a* are converted to the low-energy pixels 40*b* whereby the corrected pattern 40B can be obtained.

Figure 9A:
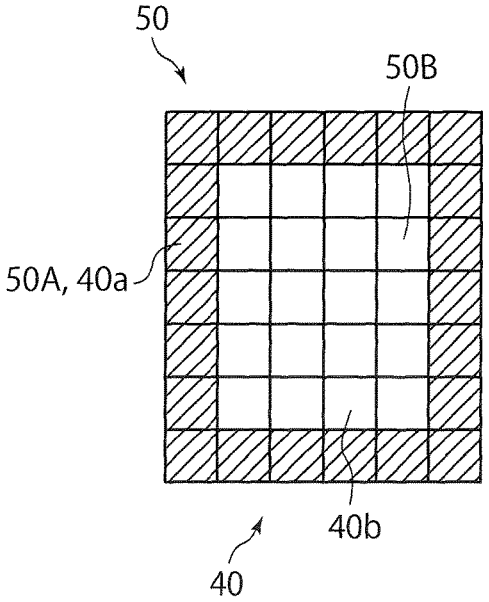
FIG. 9A is a view showing an island portion of the roughened pattern.

In the roughened pattern 40, the island portion 50 formed of a mass of the high-energy pixels 40*a* has the high-energy pixels 40*a* forming the edge area 50A, which are arranged in one row (see FIG. 9A). As shown in FIG. 9A, the inner area 50B surrounded by the high-energy pixels 40*a* forming the edge area 50A of the island portion 50 includes a plurality of the low-energy pixels 40*b*.

Figure 9B:
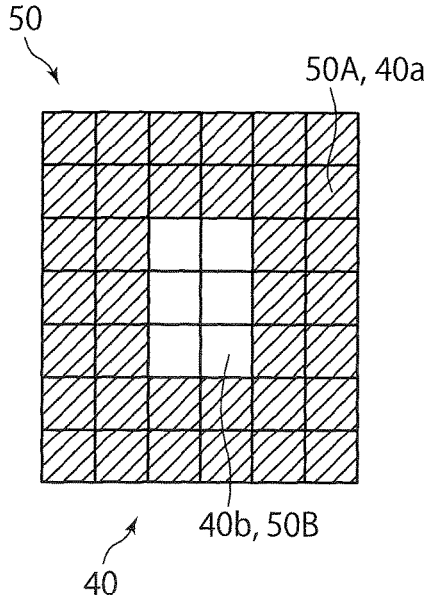
FIG. 9B is a view showing an island portion of the roughened pattern.

However, not limited thereto, in the roughened pattern 40, the island portion 50 formed of a mass of the high-energy pixels 40*a* has the high-energy pixels 40*a* forming the edge area 50A, which are arranged in two rows (see FIG. 9B). Alternatively, the high-energy pixels 40*a* forming the edge area 50A may be arranged in two or more rows.

In FIGS. 6A to 6C, the roughened pattern 40 and the glossy area 41 are formed on the image protection layer 15*e* of the printed matter 14A. When the glossy area 41 is formed, low energy is imparted to the heating elements 18*a*. Thus, the glossy area 41 has a flat shape as a whole so as to provide a glossy surface.

As long as the thermal transfer sheet 15 used in the present invention has at least the image protection layer 15*e*, the other structures thereof are not particularly limited. For example, the thermal transfer sheet 15 may be composed only of a color material layer of a certain color, instead of yellow, magenta and cyanogen, and the image protection layer. In addition, when the image protection layer 15*e* is thermally transferred to the printing medium 14 onto which an image has been printed by another printer or the like, it is sufficient that the thermal transfer sheet 15 includes only the image protection layer 15*e*.

Figure 5:
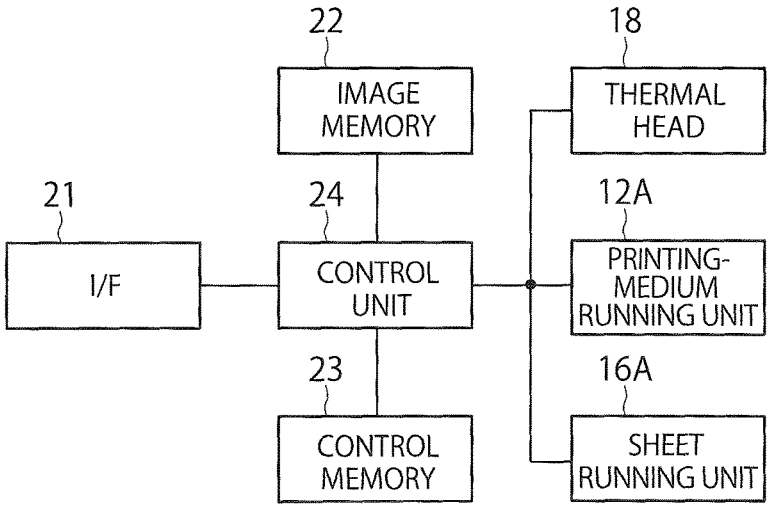
FIG. 5 is a block diagram of the printing device.

The respective constituent members of the printing device 1 as structured above are driven and controlled by the control unit 24. As shown in FIG. 5, an interface (referred to simply as I/F herebelow) 21 to which data of an image to be printed are inputted, an image memory 22 that accumulates image data inputted through I/F 21, a control memory 23 that stores a control program and so on, and the control unit 24 that controls a general operation of the thermal head 18 and so on are connected to the printing device 1. Namely, the printing-medium running unit 12A having the drive roller 12 that causes the printing medium 14 to run from a paper feeder up to a paper ejector, the thermal head 18, and the sheet running unit 16A having the take-up reel 16 and the supply reel 17 that cause the thermal transfer sheet 15 to run are connected to the control unit 24. Thus, the printing-medium running unit 12A and the sheet running unit 16A are controlled by the control unit 24.

A display apparatus such as an LCD (Liquid Crystal Display) or a CRT (Cathode Ray Tube) for displaying an image to be printed, and an electric instrument such as a storage and/or reproduction apparatus on which a storage medium is mounted are connected to the I/F 21. For example, when a moving image is displayed on the display apparatus, static image data selected by a user are inputted. In addition, when the storage and/or reproduction apparatus is connected to the I/F 21, static image data stored in a storage medium such as an optical disc, in IC card, etc. are inputted to the I/F 21.

The image memory 22 has a capacity capable of storing data of at least one image. Data of an image to be printed, which have been inputted through the I/F 21, are inputted to the image memory 22 and temporarily stored therein.

The control memory 23 stores a control program or the like that controls a generation operation of the printing device 1. The control unit 24 controls a general operation based on the control program stored in the control memory 23.

Namely, the control unit 24 controls a general operation based on the control program stored in the control memory 23. For example, the control unit 24 controls the thermal head 18 in accordance with an image to be printed, and controls the thermal head 18 such that the image protection layer 15*e* is thermally transferred, after the image has been formed on the printing medium 14. When the image protection layer 15*e* is thermally transferred, the control unit 24 drives and controls the heating elements 18*a* of the thermal head 18 in accordance with roughened pattern data stored in the control memory 23, such that a roughened pattern is formed on the surface of the image protection layer 15*e* that has been thermally transferred to the image.

To be specific, the basic pattern 40A of the roughened pattern 40 is previously stored in the control memory 23. When the image protection layer 15*e* is thermally transferred, the control unit 24 calls the basic pattern 40A stored in the control memory 23. By converting and correcting the basic pattern 40A, the control unit 24 obtains the corrected pattern 40B. Then, in accordance with the obtained corrected pattern 40B, the control unit 24 drives and controls the heating elements 18*a* of the thermal head 18, so as to form the roughened pattern 40 on the surface of the image protection layer 15*e* that has been thermally transferred to the image.

Figure 10:
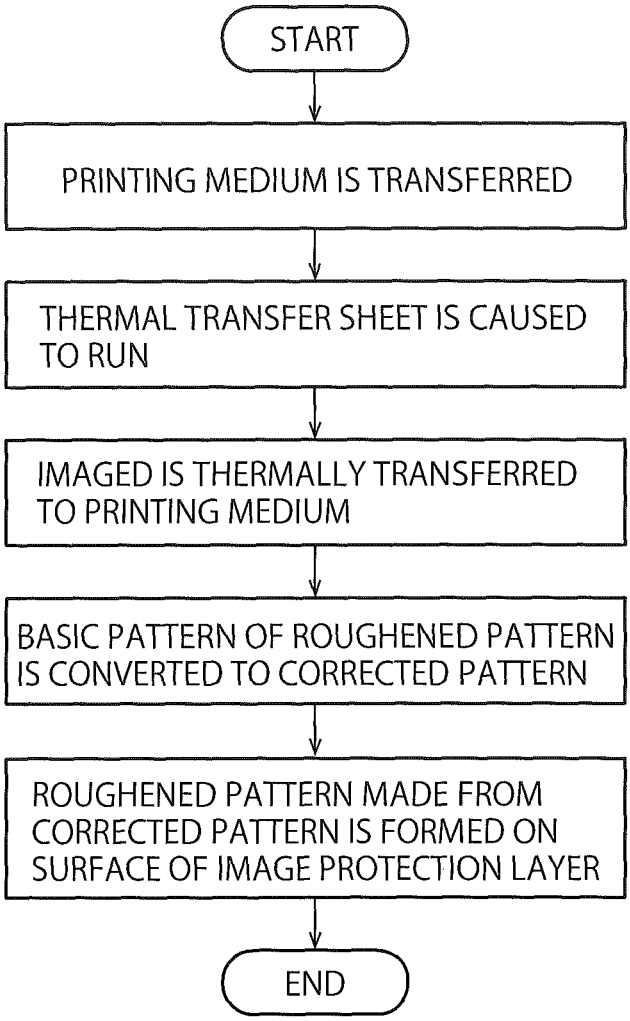
FIG. 10 is a flowchart showing a control method of the printing device.

Next, a control method of the printing device 1 as structured above is described with reference to FIG. 10. In accordance with the program stored in the control memory 23, the control unit 24 drives and controls the printing-medium running unit 12A such that the printing medium 14 is transferred to the position of the thermal head 18 (S1). In addition, in order that the yellow color material layer 15*b*, the magenta color material layer 15*c*, the cyanogen color material layer 15*d* and the image protection layer 15*e* can be thermally transferred in this order to the transferred printing medium 14, the control unit 24 drives and controls the sheet running unit 16A such that the thermal transfer sheet 15 is caused to run (S2).

Then, while causing the printing medium 14 to run at a high speed, the control unit 24 drives the thermal head 18 in accordance with data to be printed such that the yellow color material layer 15*b*, the magenta color material layer 15*c*, the cyanogen color material layer 15*d* of the thermal transfer sheet 15 are thermally transferred in this order at concentrations in accordance with the image data, whereby the images 15*bb* to 15*dd* are formed on the printing medium 14 (S3). Then, while the printing medium 14 is caused to run, the image protection layer 15*e* is thermally transferred onto the images. At this time, the control unit 24 previously converts the basic pattern 40A of the roughened pattern to the corrected pattern 40B (S4). Based on roughened pattern data (corrected pattern 40B), fine roughness (bumps and dents) are formed on the surface of the transferred image protection layer 15*e* to form the roughened pattern 40, and the glossy pattern 41 is formed on an area other than the roughened pattern 40 (S5).

In this case, the roughened pattern 40 formed on the image protection layer 15*e* of the printed matter 14A has the following structure. Namely, a pattern including a plurality of pixels 40*a*, 40*b* is referred to as basic pattern 40A, in which the high-energy pixels 40*a* and the low-energy pixels 40*b* between the high-energy pixels 40*a* are arranged like a grid. In the island portion 50 of the basic pattern 40, the high-energy pixels 40*a* of the inner area 50B surrounded by the high-energy pixels 40*a* forming the edge area 50A are converted to the low-energy pixels 40*b*, so that the corrected pattern 40B is obtained and the roughened pattern 40 is formed.

According to this embodiment, in the island portion 50 formed of a mass of the high-energy pixels 40*a* of the basic pattern 40A, the high-energy pixels 40*a* of the inner area 50B surrounded by the high-energy pixels 40*a* forming the edge area 50A are converted to the lower-energy pixels 40*b*, so as to obtain the corrected pattern 40B. By using the corrected pattern 40B, the roughened pattern 40 is formed on the surface of the image protection layer 15*e*. Thus, even when there is a mass of the high-energy pixels 40*a* in the basic pattern 40, there is no possibility that thermal energy of the high-energy pixels 40*a* in the roughened pattern 40 excessively increases. In addition, it is possible to maintain glossiness of the roughened pattern 40 as a whole, without decreasing the glossiness of the island portion 50 formed of the mass of the high-energy pixels 40*a*.

1 Printing device
11*a*, 11*b* Guide roller
12 Drive roller
13 Pinch roller
14 Printing medium
14*a* Substrate
14*b* Recipient layer 14*b*
14*c* Back layer
15 Thermal transfer sheet
15*a* Substrate
15*b* to 15*d* Color material layer
15*e* Image protection layer
16 Take-up reel
17 Supply reel
18 Thermal head
18*a* Heating element
19 Platen roller
40 Roughened pattern
40A Basic pattern
40B Corrected pattern
40*a* High-energy pixel
40*b* Low-energy pixel
41 Glossy area
50 Island portion
50A Edge area
50B Inner area surrounded by edge area

The invention claimed is:

1. A printing device comprising:

a printing-medium running unit that causes a printing medium to run;

a sheet supply unit that supplies a thermal transfer sheet onto the printing medium, the thermal transfer sheet having at least an image protection layer to be thermally transferred to the printing medium;

a thermal head having a plurality of heating elements that are linearly located in a direction perpendicular to a direction along which the printing medium runs; and a control means that drives and controls the thermal head; wherein:

the control means drives and controls the thermal head to thermally transfer the image protection layer of the thermal transfer sheet to the printing medium, and to form a roughened pattern on the image protection layer; and the roughened pattern is composed of a plurality of pixels which are arranged like a grid and include high-energy pixels and low-energy pixels between the high-energy pixels, and the roughened pattern is made based on a corrected pattern that is obtained by correcting a basic pattern that is a pattern including an island portion formed of a mass of the plurality of high-energy pixels, such that the high-energy pixel surrounded by the high-energy pixels forming an edge area of the island portion is converted to the low-energy pixel.

2. The printing device according to claim 1, wherein the high-energy pixels forming the edge area of the island portion are the high-energy pixels arranged in a plurality of rows.

3. The printing device according to claim 1, wherein the high-energy pixels forming the edge area of the island portion are the high-energy pixels arranged in a single row.

4. A printing device comprising:

a printing-medium running unit that causes a printing medium to run;

a sheet supply unit that supplies a thermal transfer sheet onto the printing medium, the thermal transfer sheet having at least an image protection layer to be thermally transferred to the printing medium;

a thermal head having a plurality of heating elements that are linearly located in a direction perpendicular to a direction along which the printing medium runs; and a control means that drives and controls the thermal head;

wherein:

the control means drives and controls the thermal head to thermally transfer the image protection layer of the thermal transfer sheet to the printing medium, and to form a roughened pattern on the image protection layer;

the roughened pattern is composed of a plurality of pixels which are arranged like a grid and include high-energy pixels and low-energy pixels between the high-energy pixels, and the roughened pattern is made based on a corrected pattern that is obtained by correcting a basic pattern that is a pattern including an island portion formed of a mass of the plurality of high-energy pixels, such that the high-energy pixel surrounded by the high-energy pixels forming an edge area of the island portion is converted to the low-energy pixel; and the corrected pattern is obtained by correcting the basic pattern such that a target high-energy pixel surrounded by the high-energy pixels adjacent thereto from above, from below, from the right and from the left is converted to the low-energy pixel.

5. The printing device according to claim 4, wherein the high-energy pixels forming the edge area of the island portion are the high-energy pixels arranged in a plurality of rows.

6. The printing device according to claim 4, wherein the high-energy pixels forming the edge area of the island portion are the high-energy pixels arranged in a single row.

7. A control method of a printing device comprising:

a step in which a printing medium is caused to run by a printing-medium running unit;

a step in which a thermal transfer sheet is caused to run on the printing medium by a sheet running unit, the thermal transfer sheet having at least an image protection layer to be thermally transferred to the printing medium; and a step in which the image protection layer of the thermal transfer sheet is thermally transferred to the printing medium by a thermal head having a plurality of heating elements that are linearly located in a direction perpendicular to a direction along which the printing medium runs, the thermal head being driven and controlled by a control means;

wherein:

the control means drives and controls the thermal head to thermally transfer the image protection layer of the thermal transfer sheet to the printing medium, and to form a roughened pattern on the image protection layer; and the roughened pattern is composed of a plurality of pixels which are arranged like a grid and include high-energy pixels and low-energy pixels between the high-energy pixels, and the roughened pattern is made based on a corrected pattern that is obtained by correcting a basic pattern that is a pattern including an island portion formed of a mass of the plurality of high-energy pixels, such that the high-energy pixel surrounded by the high-energy pixels forming an edge area of the island portion is converted to the low-energy pixel.

8. A control method of a printing device comprising:

a step in which a printing medium is caused to run by a printing-medium running unit;

a step in which a thermal transfer sheet is caused to run on the printing medium by a sheet running unit, the thermal transfer sheet having at least an image protection layer to be thermally transferred to the printing medium; and a step in which the image protection layer of the thermal transfer sheet is thermally transferred to the printing medium by a thermal head having a plurality of heating elements that are linearly located in a direction perpendicular to a direction along which the printing medium runs, the thermal head being driven and controlled by a control means;

wherein:

the control means drives and controls the thermal head to thermally transfer the image protection layer of the thermal transfer sheet to the printing medium, and to form a roughened pattern on the image protection layer;

the roughened pattern is composed of a plurality of pixels which are arranged like a grid and include high-energy pixels and low-energy pixels between the high-energy pixels, and the roughened pattern is made based on a corrected pattern that is obtained by correcting a basic pattern that is a pattern including an island portion formed of a mass of the plurality of high-energy pixels, such that the high-energy pixel surrounded by the high-energy pixels forming an edge area of the island portion is converted to the low-energy pixel; and the corrected pattern is obtained by correcting the basic pattern such that a target high-energy pixel surrounded by the high-energy pixels adjacent thereto from above, from below, from the right and from the left is converted to the low-energy pixel.

9. A manufacturing method of a printed matter comprising:

a step in which a printing medium is caused to run by a printing-medium running unit;

a step in which a thermal transfer sheet is caused to run on the printing medium by a sheet running unit, the thermal transfer sheet having at least an image protection layer to be thermally transferred to the printing medium;

a step in which the image protection layer of the thermal transfer sheet is thermally transferred to the printing medium by a thermal head having a plurality of heating elements that are linearly located in a direction perpendicular to a direction along which the printing medium runs, the thermal head being driven and controlled by a control means; and a step in which a printed matter is obtained by punching the printing medium to which the image protection layer has been thermally transferred;

wherein:

the control means drives and controls the thermal head to thermally transfer the image protection layer of the thermal transfer sheet to the printing medium, and to form a roughened pattern on the image protection layer; and the roughened pattern is composed of a plurality of pixels which are arranged like a grid and include high-energy pixels and low-energy pixels between the high-energy pixels, and the roughened pattern is made based on a corrected pattern that is obtained by correcting a basic pattern that is a pattern including an island portion formed of a mass of the plurality of high-energy pixels, such that the high-energy pixel surrounded by the high-energy pixels forming an edge area of the island portion is converted to the low-energy pixel.

10. A manufacturing method of a printed matter comprising:

a step in which a printing medium is caused to run by a printing-medium running unit;

a step in which a thermal transfer sheet is caused to run on the printing medium by a sheet running unit, the thermal transfer sheet having at least an image protection layer to be thermally transferred to the printing medium;

a step in which the image protection layer of the thermal transfer sheet is thermally transferred to the printing medium by a thermal head having a plurality of heating elements that are linearly located in a direction perpendicular to a direction along which the printing medium runs, the thermal head being driven and controlled by a control means; and a step in which a printed matter is obtained by punching the printing medium to which the image protection layer has been thermally transferred;

wherein:

the control means drives and controls the thermal head to thermally transfer the image protection layer of the thermal transfer sheet to the printing medium, and to form a roughened pattern on the image protection layer;

the roughened pattern is composed of a plurality of pixels which are arranged like a grid and include high-energy pixels and low-energy pixels between the high-energy pixels, and the roughened pattern is made based on a corrected pattern that is obtained by correcting a basic pattern that is a pattern including an island portion formed of a mass of the plurality of high-energy pixels, such that the high-energy pixel surrounded by the high-energy pixels forming an edge area of the island portion is converted to the low-energy pixel; and the corrected pattern is obtained by correcting the basic pattern such that a target high-energy pixel surrounded by the high-energy pixels adjacent thereto from above, from below, from the right and from the left is converted to the low-energy pixel.

* * * * *